US005157925A

United States Patent [19]

Denton et al.

[11] Patent Number: 5,157,925

[45] Date of Patent: Oct. 27, 1992

[54] LIGHT END ENHANCED REFRIGERATION LOOP

[75] Inventors: Robert D. Denton, Kuala Lumpur, Malaysia; Russell H. Oelfke, Houston, Tex.

[73] Assignee: Exxon Production Research Company, Houston, Tex.

[21] Appl. No.: 755,656

[22] Filed: Sep. 6, 1991

[51] Int. Cl.[5] ..... F25J 3/00

[52] U.S. Cl. ..... 62/11; 62/23; 62/335

[58] Field of Search ..... 62/8, 9, 11, 23, 38, 62/39, 335

[56] References Cited

U.S. PATENT DOCUMENTS

| | | | |
|---|---|---|---|
| 2,581,558 | 1/1952 | Ruhemann | 62/115 |
| 3,203,194 | 8/1965 | Fuderer | 62/114 |
| 3,218,816 | 11/1965 | Grenier | 62/26 |
| 3,675,435 | 7/1972 | Jackson et al. | 62/23 |
| 3,768,273 | 10/1973 | Missimer | 62/84 |
| 3,932,156 | 1/1976 | Stern | 62/23 |
| 4,140,504 | 2/1979 | Campbell et al. | 62/38 |
| 4,155,729 | 5/1979 | Gray et al. | 62/38 |
| 4,303,427 | 12/1981 | Krieger | 62/9 |
| 4,548,629 | 10/1985 | Chiu | 62/335 |
| 4,711,651 | 12/1987 | Sharma et al. | 62/23 |

FOREIGN PATENT DOCUMENTS 0254278 9/1990 European Pat. Off. .

*Primary Examiner*—Ronald C. Capossela

*Attorney, Agent, or Firm*—Pravel, Gambrell, Hewitt, Kimball & Krieger

[57] ABSTRACT

This invention relates to a closed-loop, multi-stage compression refrigeration system which uses a multi-component refrigerant wherein the compressed refrigerant is partially condensed, and the vapor and liquid streams are separated in a primary separator. The liquid stream passes through several expansion stages, providing a refrigeration duty at each stage. That portion of the refrigerant which is vaporized is recycled to an intermediate stage of the multi-stage compressor. The vapor from the primary separator, which is rich in the light component, is condensed and expanded to the lowest stage of refrigeration, providing maximum refrigeration duty for a given refrigerant composition and compressor suction pressure.

49 Claims, 1 Drawing Sheet

ETHYLENE ENHANCED PROPYLENE REFRIGERATION UNIT

ETHYLENE ENHANCED PROPYLENE REFRIGERATION UNIT

LIGHT END ENHANCED REFRIGERATION LOOP

BACKGROUND OF THE INVENTION

1. Field of the Invention

This invention relates to closed-loop compression refrigeration processes utilizing multi-stage compressors and a mixture of two or more refrigerants in the refrigeration process.

2. Description of the Related Art

In typical closed-loop compression refrigeration systems, refrigerant vapors are compressed and condensed by heat exchange. The condensate is expanded to a low pressure to produce a cooling effect which provides refrigeration duty. The refrigerant vapors from the expansion step are recycled to the compressor. The refrigerant in these systems can be a single component, such as ethylene, or a mixture of components such as propane and methane. Multi-component systems are generally used for lower temperature refrigeration.

There are several known processes utilizing multi-component refrigerants to achieve lower temperatures than that obtainable with a one component refrigerant. Examples include a cascade refrigeration system utilizing two or more separate compression loops, a multi-component refrigeration system similar to a single component system, or a separation process which partially condenses the compressed refrigerant and separates the vapor stream from the liquid stream to provide the cooler temperatures.

A cascade refrigeration system generally employs two or more compression loops wherein the expanded refrigerant from one stage is used to condense the compressed refrigerant in the next stage. Each successive stage employs a lighter, more volatile refrigerant which, when expanded, provides a lower level of refrigeration, i.e., is able to cool to a lower temperature. Such systems have the disadvantages of high cost because each stage of the cascade includes all of the components of a complete refrigeration system. Furthermore such systems have reduced reliability since the equipment in two or more complete compression loops are necessary to reach the desired refrigeration level.

Some multi-component refrigerant systems have no separation of a light and heavy phase. These systems operate in a manner very similar to a pure component system. While these systems are capable of obtaining colder temperatures than those achievable in pure component systems, they have several disadvantages. First, energy efficiency requires that the refrigerant composition be tailored to match the cooling curve of the process over the temperature range of interest. Second, the refrigeration system is much more difficult to operate because the composition of the refrigerant, which is usually three or four components, must be tightly controlled to be effective.

Other multi-component refrigeration systems separate a vapor and liquid stream in a primary separator after partial condensation. The purpose of this separation is to selectively route the condensed vapor stream to an expansion valve and heat exchanger to provide refrigeration at a cooler temperature.

For example, in U.S. Pat. No. 2,581,558, the multi-component refrigerant is compressed in a single stage compressor. This compressed refrigerant is partially condensed and the vapor stream, rich in the light component, is separated from the liquid stream in a primary separator. The liquid stream is split into two streams. The first stream is routed through an expansion valve and into a heat exchanger where it condenses the vapor from the primary separator and the second stream is routed through an expansion valve and into a heat exchanger where it cools an outside stream. The vapor from the primary separator, having been condensed in a heat exchanger, goes through an expansion valve and into another heat exchanger where it also cools an outside stream. The refrigerant vapors from the heat exchangers are combined, routed through several heat exchangers to provide heat integration, and returned to the suction of the compressor.

In U.S. Pat. No. 3,203,194, the multi-component refrigerant is compressed in a single stage compressor. This compressed refrigerant is partially condensed, and the vapor stream is separated from the liquid stream in a primary separator. The liquid stream is cooled in a heat exchanger, expanded across a valve and routed to a condenser where it condenses the vapors from the primary separator. The condensed primary separator vapor stream exiting from the condenser is expanded across a valve and routed through a heat exchanger to provide refrigeration duty. The mixed phase refrigerant from the exchanger is mixed with the liquid from the primary separator downstream of the expansion valve and upstream from the vapor condenser. After providing condensing duty, this combined stream is routed through two heat exchangers to provide heat integration, wherein the refrigerant is vaporized and returned to the suction of the compressor.

The refrigeration schemes shown in both U.S. Pat. Nos. 2,581,558 and 3,203,194 have several disadvantages. First, they are not optimally energy efficient because they do not obtain the maximum amount of refrigeration duty per compressor horse-power expended. These schemes do not optimize the driving force for heat exchange, which is the temperature differential between the two streams, nor do they compress the refrigerant in stages thereby reducing compressor horsepower. Second, these refrigeration systems do not achieve the lowest possible temperature upon expansion of the condensed primary separator vapor stream because these streams are not expanded to the lowest possible pressure, that of the compressor suction. The streams after the expansion valve and the heat exchanger providing the refrigeration duty must pass through several heat integration heat exchangers which cause pressure drops and which therefore increase the required pressure to which these streams must be expanded in order to ensure sufficient driving force to push the vapor through the heat exchangers to the compressor suction. Third, these refrigeration schemes are not flexible. They do not allow continuous, dynamic control of the temperature at the lowest level of refrigeration without significantly changing the pressure to which the refrigerant is expanded or significantly changing the pressure of the compressor discharge condenser and primary separator.

Thus, there is still a need in the industry for a multi-component refrigeration system which is more energy efficient, more flexible, and has improved operability over other multi-component refrigeration processes. This invention provides a high efficiency refrigeration system that achieves temperatures lower than comparable multi-component refrigeration systems while maintaining an ease of operation comparable to single component refrigeration systems.

SUMMARY OF THE INVENTION

This invention comprises a closed-loop compression refrigeration system wherein the compressed multi-component refrigerant is partially condensed, and the vapor and liquid streams are separated in a primary separator. The liquid stream passes through several liquid expansion stages, providing a refrigeration duty at each stage. Some of this liquid stream is vaporized while providing the refrigeration duty and is recycled at each expansion stage to an intermediate stage of a multi-stage compressor. The vapor stream from the primary separator, which is rich in the lower boiling point components is condensed, expanded and mixed with the remaining liquid from the last liquid expansion stage. The combined refrigerant stream is expanded, providing a refrigeration duty at a lower temperature level than that provided by the liquid refrigerant stream. The resultant vapors are recycled back to the suction of the multi-stage compressor. Alternatively, all of the heavier refrigerant could be vaporized in the last liquid expansion stage, and the condensed vapor from the primary separator could be used alone to obtain an even lower temperature level of refrigeration.

DETAILED DESCRIPTION OF THE INVENTION

Figure 1:
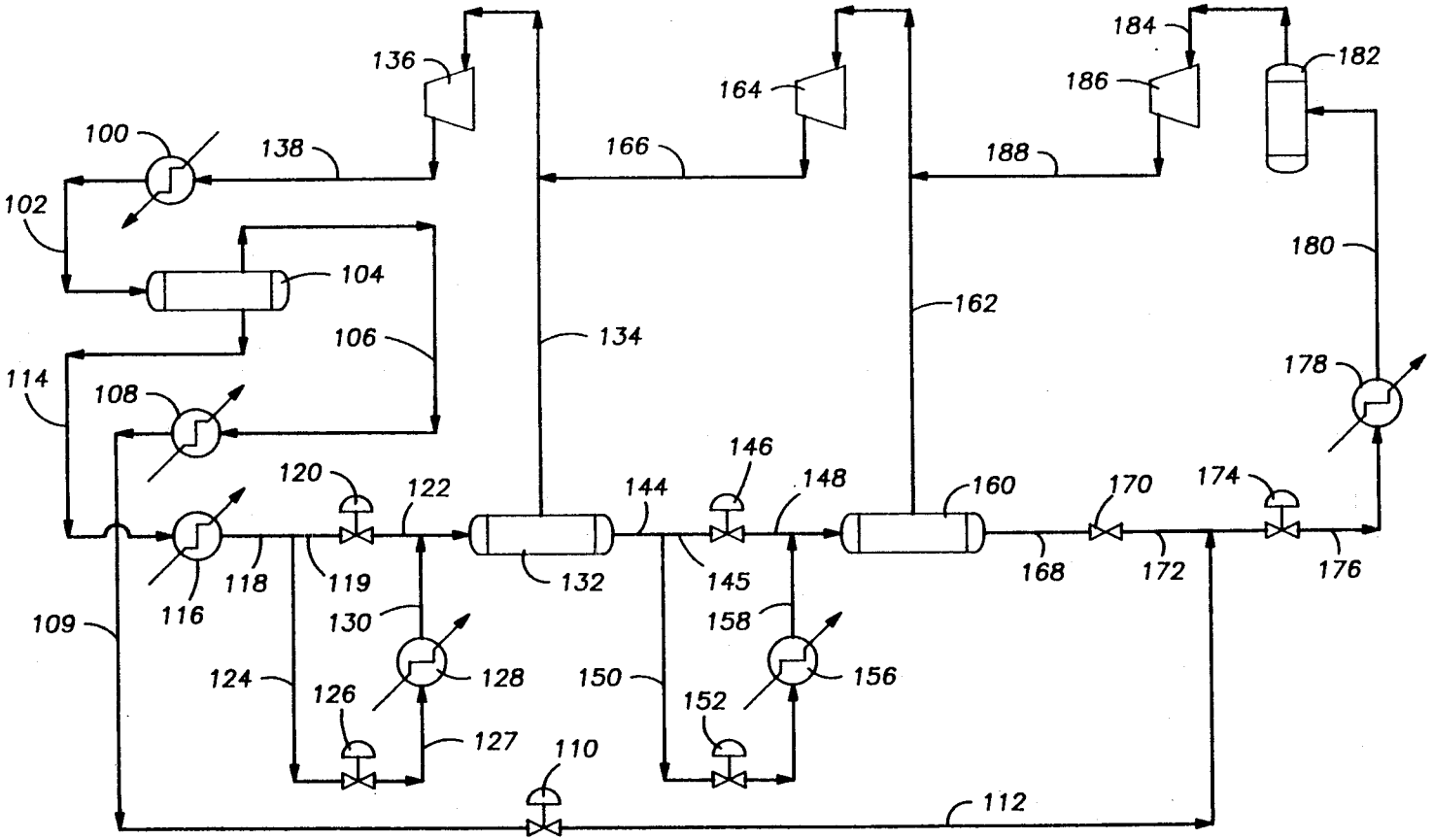
FIG. 1 is a schematic representation of the refrigeration system of this invention.

The refrigeration system of this invention has several advantages over other multi-component refrigeration systems. The refrigeration system disclosed herein is more energy efficient than other refrigeration schemes. This improved energy efficiency is due to two factors. First, the expansion of the liquid in stages from the primary separator, wherein each successive stage provides a lower temperature level of refrigeration, may be used more efficiently to minimize the temperature differential between the process streams and the refrigerant stream, thereby providing the minimum driving force for heat exchange. Here, the routing of refrigerant vapors from each expansion stage to an appropriate intermediate compressor stage provides these varying levels of refrigeration in the most energy efficient manner. Second, at each refrigerant expansion step, the refrigerant is expanded to the pressure, required for entering the compressor or intermediate stage suction. The vaporized refrigerant is not routed through heat integration heat exchangers as in other refrigeration schemes which require a higher final vapor pressure at the refrigeration service outlet because of the pressure drop taken across the heat integration exchangers. Therefore, this system achieves a lower temperature than other systems using comparable components at each level.

Also, the refrigeration process disclosed herein is more flexible than other refrigeration schemes in that the lowest temperature level of refrigeration can be varied in a continuous dynamic fashion without affecting the higher temperature levels of refrigeration. This flexibility is accomplished by adjusting the recycle rate of the light component(s), which is removed as a vapor from the primary separator.

Furthermore, achieving a lower temperature in the lowest refrigeration level is the main objective of using a multi-component refrigerant system over a single refrigerant system. This refrigeration process achieves a lower temperature upon the expansion of the condensed primary separator vapor stream for a given refrigerant composition and compressor suction pressure. This lower temperature is achieved because this stream is expanded to the compressor suction pressure, not a higher pressure necessitated by the pressure drops incurred across the heat integration heat exchangers of other refrigeration schemes.

The inventive refrigeration system is illustrated schematically in FIG. 1. A compressor having from about 1 to about 6 stages (FIG. 1 showing 3 stages, 136, 164 and 186) compresses a refrigerant. Preferably, the compressor is multi staged having from about 2 to about 6 stages. This refrigeration system is not limited to the use of particular refrigerant components, and a wide variety of combinations are possible. Although any number of components may form the refrigerant mixture, there are preferably in the range of about 2 to about 7 components in the refrigerant mixture. For example, the refrigerants used in this mixture may be selected from well-known halogenated hydrocarbons and their azeotrophic mixtures, as well as, various hydrocarbons. Some examples are methane, ethylene, ethane, propylene, propane, isobutane, butane, butylene, trichloromonofluoromethane, dichlorodifluoromethane, monochlorotrifluoromethane, monochlorodifluorumethone, tetrafluoromethane, monochloropentafluoroethane and any other hydrocarbon-based refrigerant known to those skilled in the art and any hydrocarbon refrigerant known to those skilled in the art. Non-hydrocarbon refrigerants, such as nitrogen, argon, neon and helium may also be used. The only criteria for the components is that they be compatible and have different boiling points, e.g., at least of about 50° F. Thus, the refrigerant mixture may be tailored to a particular application. Suitable mixtures include those comprising propane and ethane, or those comprising propylene and ethylene, or those comprising tetrafluoromethane and monochlorodifluoromethane. The preferred mixture of this invention is 90% propylene and 10% ethylene.

The compressed refrigerant is partially condensed in condenser 100 using an ambient temperature cooling medium, such as, cooling water. This partially condensed stream is routed through line 102 to a primary separator 104 which separates the liquid and vapor. The liquid stream, which exits line 114, is rich in the heavier or higher boiling point refrigerant(s), and the vapor stream, which exits line 106, is rich in the lighter or lower boiling point refrigerant(s).

The liquid stream 114 from the primary separator can be further cooled in cooler 116 by an outside cooling medium, if desired. This stream, exiting through line 118, is subsequently expanded in an expansion stage. Preferably there are from about 2 to about 5 expansion stages. Each expansion stage preferably contains the following equipment: an expansion means, such as an expansion valve, for partially vaporizing the refrigerant and a separation drum which separates the mixture of liquid and vapor refrigerant. Each stage may also optionally contain a heat exchanger which uses the expanded refrigerant to cool an outside stream.

An example of an expansion stage is shown in FIG. 1 which includes: expansion valve 126, heat exchanger 128 and liquid-vapor separator 132. The liquid refrigerant in line 118 can also be split into two streams for added flexibility in the process. For example, instead of expanding the stream across an expansion valve 126, some or all of the stream may be routed through line 119 to expansion valve 120 and into the liquid-vapor separation 132 through line 122. In this embodiment, the remaining stream from line 118 enters expansion valve 126 through line 124, thereby at least partially vaporizing and cooling the refrigerant stream. This stream is then routed through line 127 to a heat exchanger 128, commonly called a "chiller" or "evaporator," where it cools an outside process stream while some of the liquid refrigerant is vaporized. Heat exchanger 128 could also be used to condense the vapors in line 106 from the primary separator 104, thereby acting in conjunction with, or replacing, heat exchanger 108. The expansion and heat exchange creates a refrigerant stream 130 which is part vapor and part liquid. This stream 130 is combined with stream 122, which has also been expanded to a comparable pressure, and enters the separator 132. The liquid and vapor are separated in separator 132. The vapor is routed through line 134 to an intermediate stage of the compressor 136, and returned to the condenser 100 through line 138. The liquid is routed through line 144 to the next expansion stage. This process is repeated in each subsequent expansion stage.

In the second expansion stage, the liquid from line 144 can be split into two streams, e.g., lines 145 and 150. Liquid from line 145 can be expanded across valve 146 and routed to separator 160 through line 148. As in the first expansion step, this option gives added flexibility to the process. The liquid in line 150 enters expansion valve 152, exits through line 154, and is routed through heat exchanger 156 which cools an outside process stream. The vapor and liquid exiting the heat exchanger 156 is combined with stream 148, which has been expanded to a comparable pressure.

In the last expansion stage, illustrated in FIG. 1 by expansion device 152, heat exchanger 156 and liquid-vapor separator 160, there are two alternate modes of operation. First, the expansion device 152 and heat exchanger 156 may be operated at such a pressure and temperature that all of the refrigerant is vaporized. In this mode valve 170 may be closed because there will be no liquid exiting separator 160 through line 168. This operation will produce the coolest temperature in heat exchanger 178 since only the condensed vapor from the primary separator 104, which is rich in the lighter component(s), is expanded across expansion device 174. When valve 170 is closed, the condensed vapor from heat exchanger 108 exits through line 109 and is expanded across valve 110. It enters line 172 through line 112 and is further expanded across valve 174 where it enters the heat exchanger 178 through line 176.

In the second mode of operation, the expansion valve 152 and heat exchanger 156 may be operated such that all refrigerant is not vaporized, and separator 160 is used to separate a vapor and liquid stream. The liquid stream 168 is routed through expansion valve 170 where it exits in line 172 and is mixed with the condensed vapor from line 112. In either mode, the vapor from separator 160 exits through line 162 and is compressed in compressor 164. The compressed stream exits through line 166 and is combined with the stream in line 134.

As stated earlier, the vapor from the primary separator 104 is condensed in heat exchanger 108. This condensing duty may be supplied by either an outside process stream or heat exchanger 128 which is in the first expansion stage. If desired, the heat exchangers in other expansion stages may also be used to condense this stream. This condensed vapor stream is routed through expansion device 110 and mixed in line 172 with any liquid from the last expansion stage. After expansion through valve 174, this cooled stream is routed through heat exchanger 178 which cools an outside process stream and vaporizes substantially all of the refrigerant. This vapor is routed through line 180 to vessel 182 and suctioned through line 184 to compressor 186. The compressed stream exiting through line 188 is combined with stream 162.

The following example is intended to illustrate the invention as described above and claimed hereafter and is not intended to limit the scope of the invention.

EXAMPLE

A mixture of hydrocarbon refrigerants, consisting of 9 parts propylene and 1 part ethylene, was compressed in a multi-stage compressor in a refrigeration system like that illustrated schematically in FIG. 1. The mixture entered the condenser 100 at a temperature of 176° F., and exited through line 102 at the rate of 1000 lb-moles/hr, a pressure of 232 psia and a temperature of 81° F. The condenser used ambient temperature cooling water, and the mixture was partially condensed. This partially condensed stream was routed to the primary separator 104, where a vapor stream consisting of a mixture of 74.2% propylene and 25.8% ethylene exited through line 106 at the rate of 45 moles/hr. A liquid stream, consisting of 90.7% propylene and 9.3% ethylene exited through line 114 at the rate of 955 moles/hr.

The liquid stream 114 from the primary separator 104 was cooled to 32° F. using a cooled outside stream in heat exchanger 116. This stream was routed to the first expansion stage where the liquid was expanded from 232 psia to 46 psia across expansion valve 126 and routed to heat exchanger 128, providing a refrigeration duty of 4578 kBtu/hr at a temperature of −8° F. This mixed phase refrigerant stream was routed to separation drum 132 which separated a vapor stream from a liquid stream. The vapor from separator 132 was routed to the last stage 136 of the compressor. The liquid from separator 132 was routed to the next expansion stage where it was expanded from a pressure of 46 psia to 28 psia across expansion valve 152. Heat exchanger 156 provided a refrigeration duty of 640 kBtu/hr at a temperature of −27° F. Separator 160 was used to separate the resultant vapor refrigerant from the liquid refrigerant. This vapor refrigerant was routed to intermediate stage 164 of the compressor.

The vapor from the primary separator 104 was condensed at 42° F. in heat exchanger 108 using a cooled outside stream. This condensed stream was expanded from 232 psia to 28 psia across expansion valve 110. This stream 112 was combined with the expanded liquid from separator 160 and further expanded from 28 psia to 16 psia across expansion valve 174 resulting in a cooling to −65° F. This stream was routed to heat exchanger 178, providing a refrigerant duty of 874 kBtu/hr and warming the refrigerant to −56° F., such that substantially all of the refrigerant was vaporized. As in the first stage, this vapor was routed to the first stage 186 of the compressor. The vapor was subsequently compressed in stages and entered condenser 100 to complete the cycle.

The principle of the invention and the best mode contemplated for applying that principle have been described. It is to be understood that the foregoing is illustrative only and that other means and techniques can be employed without departing from the true scope of the invention defined in the following claims.

We claim:

1. A multi-stage compression refrigeration process for operation with a mixture of refrigerants having different boiling points, comprising the steps of:

a. compressing the mixture of said refrigerants in a multi-stage compressor;

b. partially condensing said compressed refrigerants to form a mixture of liquid phase refrigerant and vapor phase refrigerant;

c. separating said liquid phase refrigerant from said vapor phase refrigerant;

d. expanding said liquid phase refrigerant in at least two expansion stages, each expansion stage including the steps of expanding the liquid phase refrigerant, performing a refrigeration duty by heat exchange with the expanded refrigerant, forming a new vapor phase with each heat exchange, separating remaining liquid from each new vapor phase, routing the new vapor phase to an intermediate stage of the multi-stage compressor, and routing remaining liquid to the next expansion stage;

e. expanding the vapor phase refrigerant from step (c), and combining the stream with remaining liquid from the last expansion stage of step (d), routing this through an expansion means, performing a refrigeration duty by heat exchange with the expanded stream, and routing the resultant vapors to the first stage suction of the multi-stage compressor.

2. The process of claim 1 wherein the vapor phase from step (c) is condensed in 1(e) using refrigeration duty provided at the first stage of liquid expansion in 1(d).

3. The process of claim 1 wherein in the last expansion stage, all refrigerant is vaporized and routed to an intermediate stage of the compressor such that only condensed vapor from step 1(e) is expanded and routed to a heat exchanger upstream of the first stage suction of the multi-stage compressor.

4. The process of claim 1 comprising from 2 to about 5 intermediate expansion stages.

5. The process of claim 4, wherein the expansion means comprise an expansion engine which recovers work.

6. The process of claim 5 wherein the refrigerant comprises a mixture of propylene and ethylene.

7. The process of claim 5 wherein said multi-stage compressor has 2 to 6 stages.

8. The process of claim 7 wherein the refrigerant comprises a mixture of tetrafluoromethane and monochlorodifluoromethane.

9. The process of claim 7 wherein the refrigerant mixture comprises 2 to 7 individual components.

10. The process of claim 9 wherein the refrigerant comprises a mixture of propylene and ethylene.

11. The process of claim 9 wherein the refrigerant comprises a mixture of propane and ethane.

12. The process of claim 1 wherein said multi-stage compressor has 2 to 6 stages.

13. The process of claim 1 wherein the refrigerant mixture comprises 2 to 7 individual components.

14. The process of claim 1 wherein the expansion means comprise thermal expansion valves.

15. The process of claim 14 comprising from 2 to about 5 intermediate expansion stages.

16. The process of claim 1 wherein the refrigerant comprises a mixture of propylene and ethylene.

17. The process of claim 1 wherein the expansion means comprise an expansion engine which recovers work.

18. The process of claim 1 wherein the refrigerant comprises a mixture of tetrafluoromethane and monochlorodifluoromethane.

19. The process of claim 18 comprising from 2 to about 5 intermediate expansion stages.

20. The process of claim 1 wherein the refrigerant comprises a mixture of propane and ethane.

21. The process of claim 1 wherein the refrigerant comprises a mixture of tetrafluoromethane and monochlorodifluoromethane.

22. A multi-stage compression refrigeration process for operation with a mixture of refrigerants having different boiling points, comprising the steps of:

a. compressing the mixture of said refrigerants in a compressor;

b. partially condensing said compressed refrigerants to form a mixture of liquid phase refrigerant and vapor phase refrigerant;

c. separating said liquid phase refrigerant from said vapor phase refrigerant;

d. expanding said liquid phase refrigerant in at least one expansion stage, wherein the expansion stage includes the steps of expanding the liquid phase refrigerant, performing a refrigeration duty by heat exchange with the expanded refrigerant, forming a new vapor phase with each heat exchange, separating any remaining liquid from each new vapor phase and routing the vapor phase to an intermediate stage of the multi-stage compressor; and e. condensing the vapor phase refrigerant from step (c), expanding the condensed liquid stream and combining the stream with any remaining liquid from step (d), routing this through an expansion means, performing a refrigeration duty by heat exchange with the expanded stream, and routing the resultant vapors to the compressor.

23. The process of claim 22 wherein the vapor phase from step (c) is condensed in 1(e) using refrigeration duty provided at the stage of liquid expansion in 1(d).

24. The process of claim 22 wherein the refrigerant mixture comprises 2 to 7 individual components.

25. The process of claim 22 wherein the expansion means comprise thermal expansion valves.

26. The process of claim 22 wherein the refrigerant comprises a mixture of propylene and ethylene.

27. The process of claim 22 wherein the refrigerant comprises a mixture of propane and ethane.

28. The process of claim 22 wherein the refrigerant comprises a mixture of tetrafluoromethane and monochlorodifluoromethane.

29. The process of claim 22 wherein in the last expansion stage, all refrigerant is vaporized and routed to an intermediate stage of the compressor such that only condensed vapor from step 1(e) is expanded and routed to a heat exchanger upstream of a first stage of the multi-stage compressor.

30. A multi-stage compression refrigeration process for operation with a mixture of refrigerants having different boiling points, comprising the steps of:

a. compressing the mixture of said refrigerants in a multi-stage compressor;

b. partially condensing said compressed refrigerants to form a mixture of liquid phase refrigerant and vapor phase refrigerant;

c. separating said liquid phase refrigerant from said vapor phase refrigerant;

d. expanding said liquid phase refrigerant in at least two expansion stages, each expansion stage including the steps of expanding the liquid phase refrigerant, performing a refrigeration duty by heat exchange with the expanded refrigerant, forming a new vapor phase with each heat exchange, separating any remaining liquid from each new vapor phase, routing the new vapor phase to an intermediate stage of the multi-stage compressor, and routing any remaining liquid to the next expansion stage;

e. condensing the vapor phase refrigerant from step (c), expanding the condensed liquid stream and combining the stream with any remaining liquid from the last expansion stage of step (d), routing this through an expansion means, performing a refrigeration duty by heat exchange with the expanded stream, and routing the resultant vapors to the first stage suction of the multi-stage compressor; wherein in the last expansion stage, all refrigerant is vaporized and routed to an intermediate stage of the compressor such that only condensed vapor from step 1(e) is expanded and routed to a heat exchanger upstream of the first stage suction of the multi-stage compressor.

31. The process of claim 30 wherein the vapor phase from step (c) is condensed in 1(e) using refrigeration duty provided at the first stage of liquid expansion in 1(d).

32. The process of claim 30 comprising from 2 to about 5 intermediate expansion stages.

33. The process of claim 32, wherein the expansion means comprise an expansion engine which recovers work.

34. The process of claim 33 wherein the refrigerant comprises a mixture of propylene and ethylene.

35. The process of claim 33 wherein said multi-stage compressor has 2 to 6 stages.

36. The process of claim 35 wherein the refrigerant comprises a mixture of tetrafluoromethane and monochlorodifluoromethane.

37. The process of claim 35 wherein the refrigerant mixture comprises 2 to 7 individual components.

38. The process of claim 37 wherein the refrigerant comprises a mixture of propylene and ethylene.

39. The process of claim 37 wherein the refrigerant comprises a mixture of propane and ethane.

40. The process of claim 30 wherein said multi-stage compressor has 2 to 6 stages.

41. The process of claim 30 wherein the refrigerant mixture comprises 2 to 7 individual components.

42. The process of claim 30 wherein the expansion means comprise thermal expansion valves.

43. The process of claim 42 comprising from 2 to about 5 intermediate expansion stages.

44. The process of claim 30 wherein the refrigerant comprises a mixture of propylene and ethylene.

45. The process of claim 30 wherein the expansion means comprise an expansion engine which recovers work.

46. The process of claim 30 wherein the refrigerant comprises a mixture of tetrafluoromethane and monochlorodifluoromethane.

47. The process of claim 46 comprising from 2 to about 5 intermediate expansion stages.

48. The process of claim 30 wherein the refrigerant comprises a mixture of propane and ethane.

49. The process of claim 30 wherein the refrigerant comprises a mixture of tetrafluoromethane and monochlorodifluoromethane.

* * * * *